United States Patent [19]

Vola

[11] 4,341,464

[45] Jul. 27, 1982

[54] REPRODUCTION APPARATUS EMPLOYING A CASSETTE WITH A FINITE BELT

[75] Inventor: Mathias J. J. M. Vola, Velden, Netherlands

[73] Assignee: Océ-Nederland B.V., Venlo, Netherlands

[21] Appl. No.: 234,890

[22] Filed: Feb. 17, 1981

[30] Foreign Application Priority Data

Feb. 27, 1980 [NL] Netherlands ..... 8001166

[51] Int. Cl.[3] ..... G03G 15/00

[52] U.S. Cl. ..... 355/16; 355/3 BE; 355/77

[58] Field of Search ..... 355/16, 38 E, 77; 242/67.3 R, 192

[56] References Cited

U.S. PATENT DOCUMENTS

| | | | |
|---|---|---|---|
| 3,480,361 | 1/1969 | Doi et al. | 355/16 |
| 3,706,489 | 12/1972 | Moxness et al. | 355/3 R |
| 4,068,942 | 1/1978 | Penwell | 355/16 |
| 4,076,183 | 2/1978 | Kingsley | 242/67.3 R |
| 4,076,410 | 2/1978 | Kono et al. | 355/16 |
| 4,231,652 | 11/1980 | Moser et al. | 355/16 X |

FOREIGN PATENT DOCUMENTS

| | | | |
|---|---|---|---|
| 1434220 | 5/1976 | United Kingdom | 355/16 |
| 1444808 | 8/1976 | United Kingdom | 355/16 |

*Primary Examiner*—Richard L. Moses

*Attorney, Agent, or Firm*—Albert C. Johnston

[57] ABSTRACT

A reproduction apparatus comprises a rotatable drum having trained over its circumferential surface a length of finite belt that extends and is transportable back and forth between two supply reels inside the drum and is impressible with image information to be transferred to receiving material at a transfer station adjacent to the drum surface. During transport of the belt in either direction relative to the drum surface the drum is held at a peripheral velocity which depends upon the direction of the belt transport and, considering both magnitude and direction, is equal to a given processing velocity of the belt relative to the transfer station minus the velocity of transport of the belt over the drum surface. Thus, the transport of the belt relative to the transfer station is always in the same direction and of the same magnitude, whether the belt is being transported from one reel to the other or back from the other to the one reel.

7 Claims, 8 Drawing Figures

REPRODUCTION APPARATUS EMPLOYING A CASSETTE WITH A FINITE BELT

This invention relates to a reproduction apparatus comprising a cassette provided with two reels for supplying over a part of the circumferential surface of the cassette a length of a finite belt on which image information can be applied.

A reproduction apparatus is known, for instance as disclosed in Dutch patent application No. 7107910, in which a finite imagable belt is transported back and forth between two supply reels so as to pass over part of the circumferential surface of a cassette and drive elements are provided by which the belt is moved at a first velocity over the circumferential surface when being transported from the first to the second supply reel, thereby being moved past an image transfer station at a processing velocity, and is moved at a second velocity over the circumferential surface when being transported back from the second to the first supply reel. This known apparatus is an indirect electrophotograhic copying apparatus employing a trapezium-shaped cassette having two belt supply reels between which a photoconductive belt can be transported back and forth over the circumferential surface of the cassette. The trapezium-shaped cassette is rotatable about an axis of rotation and is located on a frame that can be slid in and out of the apparatus. The axis of rotation is located in a plane of symmetry of the cassette in such a way that when the frame is taken out, the cassette rotated 180° about the axis of rotation and the frame then slid back into the apparatus, the relative position of the circumferential surface in the apparatus is once more the same as it was before the rotation. In that way the belt can consistently be conveyed in the same direction past various processing stations in the apparatus, while the supply reels serve alternately as a belt feeding reel and a belt collecting reel.

The known apparatus has a drawback in that a comprehensive unit provided with accurate positioning elements is required in order to take the cassette out of the apparatus, to reverse it by 180° and again insert it in the apparatus and, subsequently, to reposition the belt accurately in relation to the processing stations. Reversing the cassette thus demands a considerable number of operations by the operator. For that reason, each time the cassette is reversed the apparatus is not usable for reproduction for a considerable length of time.

The principal object of the present invention is to provide a reproduction apparatus of the type employing a cassette with belt supply reels as mentioned hereinabove, but in which the belt can be conveyed consistently in the same direction past the processing stations without need to take the cassette out of the apparatus for that purpose.

According to the present invention the reproduction apparatus is provided with a cassette comprising a rotatable drum having two belt supply reels mounted inside the drum and drum driving means are provided whereby when the belt is being transported at a first velocity from a first to the second reel the drum is kept at a peripheral velocity which, in magnitude and direction, is equal to the processing velocity minus the first belt transport velocity, and when the belt is being transported at a second velocity from the second to the first reel the drum is rotated at a peripheral velocity which, in magnitude and direction, is equal to the processing velocity minus the second belt transport velocity.

In this way the peripheral velocity of the drum can be consistently selected so that, at every direction and velocity of transport of the belt, the belt moves at the required processing velocity (both in magnitude and direction) past the image transfer station, and it no longer is necessary to take the cassette out of the apparatus when the reels have to be changed in function for feeding and collecting the belt.

In this way as well, since the velocity of transport of the belt over the circumferential surface of the drum is related to both the processing velocity and the peripheral velocity of the drum, the belt transport velocity can be set to the optimum value for each condition of operation of the apparatus.

According to a further feature of the invention, a reproduction apparatus as specified above is provided with a belt on which the image information can be applied to form master images for use repeatedly to reproduce the image information on sheet-like receiving material, and a switchable sheet reversing unit is located in the path of transport of the resulting reproductions, this reversing unit being provided with means for switching it on during transport of the belt in a first direction over the circumferential surface of the drum and for switching it off during transport of the belt in the other direction over the circumferential surface of the drum.

The reproduction apparatus so constituted pursuant to the invention is especially suitable for the fast and repeated reproduction (duplication) of the image information on the belt, with no loss of time for repeatedly removing, reversing and again inserting the drum. With this apparatus, further, the transport velocities and peripheral velocities can be selected in such a way that successive sections of the belt which carry the image information will move consistently and successively past the image transfer station, independently of the direction of transport of the belt over the circumferential surface of the drum. Consequently, by the on and off switching actions of the sheet reversing unit in dependence upon the direction of transport of the belt over the circumferential surface of the drum, the sequence of the copy sheets in stacks to be formed of them will consistently be the same, so that no separate sorting unit is required for the formation of several equivalent stacks.

Among the belts suitable for the formation of master images that can be used repeatedly to make reproductions are, for example, magnetic belts on which the image information is fixed in magnetic form; more or less electrically conductive belts on which the image information is applied in the form of insulating material; flexographic belts, lithographic master belts; and others. Preferably, such a reproduction apparatus is provided with a signal transmitter which emits a signal corresponding to the direction of transport of the belt over the circumferential surface of the drum, and with a control unit which reacts to the signal of the transmitter for switching the sheet reversing unit on and off.

According to a further advantageous embodiment of the invention, in a reproduction apparatus with which the image information is reproducible on sheet-like receiving material, the linear circumference of the drum is made equal to twice the size of the receiving material, viewed in the direction of movement of the image information through the transfer station, and the drive means for rotating the drum are constituted so that the drum is not driven during the transport of the belt from the first to the second supply reel, while during transport of the belt from the second to the first supply reel the drum is driven at a peripheral velocity that in magnitude and direction, is equal to twice the processing velocity.

By virtue of this arrangement, every imaging section of the belt can consistently move one time fully through the image transfer station during each transport of the belt, i.e., during the transport from the first supply reel to the second and during transport from the second supply reel to the first. In this way all sections of the belt are utilized to an equal degree. Further, when employing a belt carrying the image information in the form of master images that can be reproduced repeatedly, the master images can be applied on the belt consecutively and the length of time required for the repeated transfer of the image information can be minimal, because successive master images move past the image transfer station not only in a consistently successive way, but also in consistently consecutive order, independent of the direction of transport of the belt over the circumferential surface of the drum.

The invention will be further understood from the following detailed description and the accompanying drawings of illustrative embodiments thereof. In the drawings.

Figure 4:
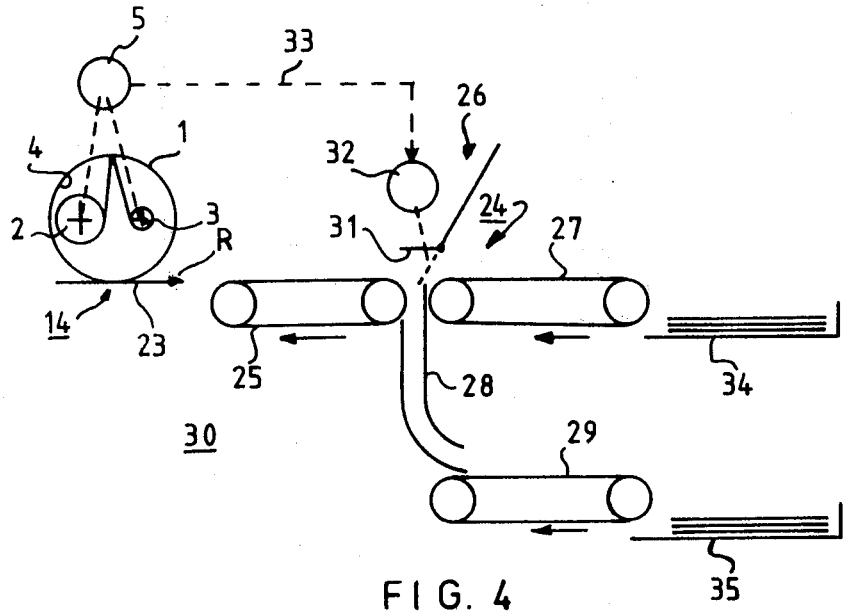
Figure 2A:
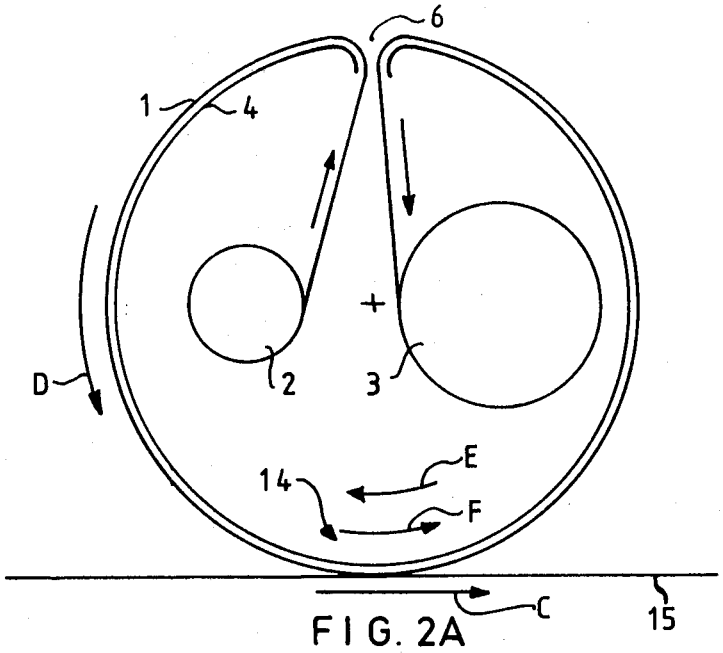
FIG. 2A is a diagram indicating the directions of movements during transport of the belt from the first to the second supply reel in the use of the apparatus of FIG. 1.
Figure 2B:
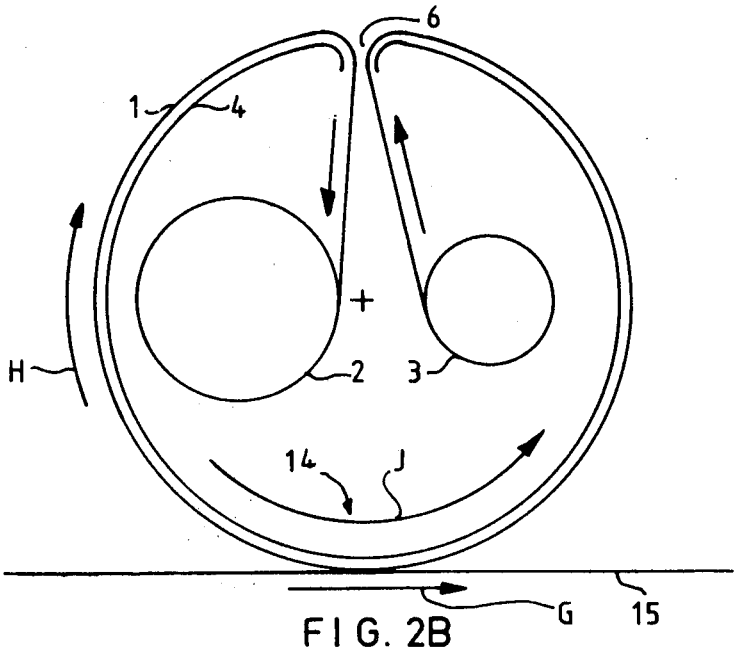
FIG. 2B is a similar diagram indicating the directions of movements during transport of the belt from the second to the first supply reel.
Figure 3A:
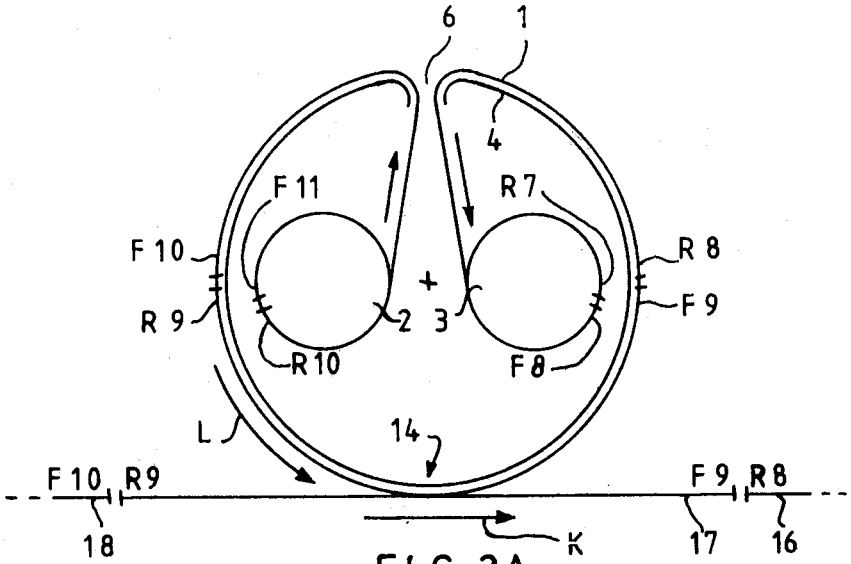
Figure 3B:
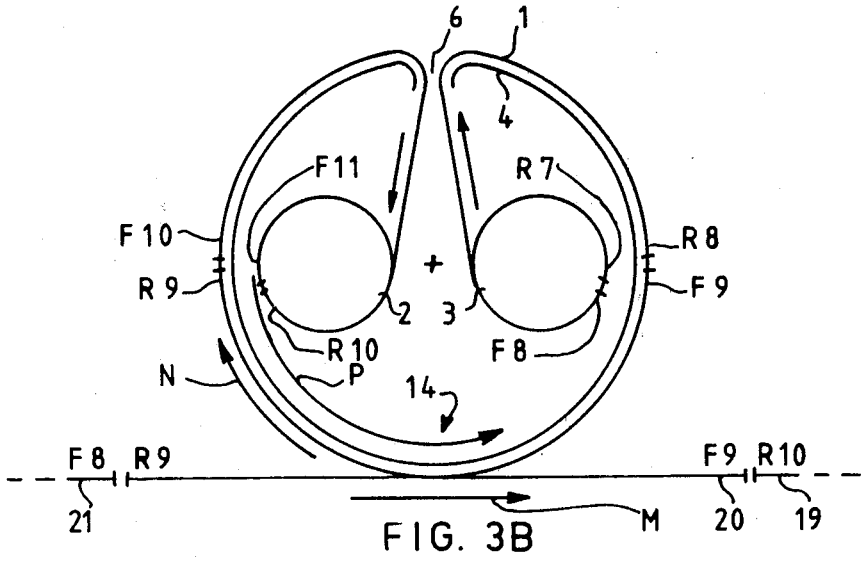
Figures 5A, 5B:
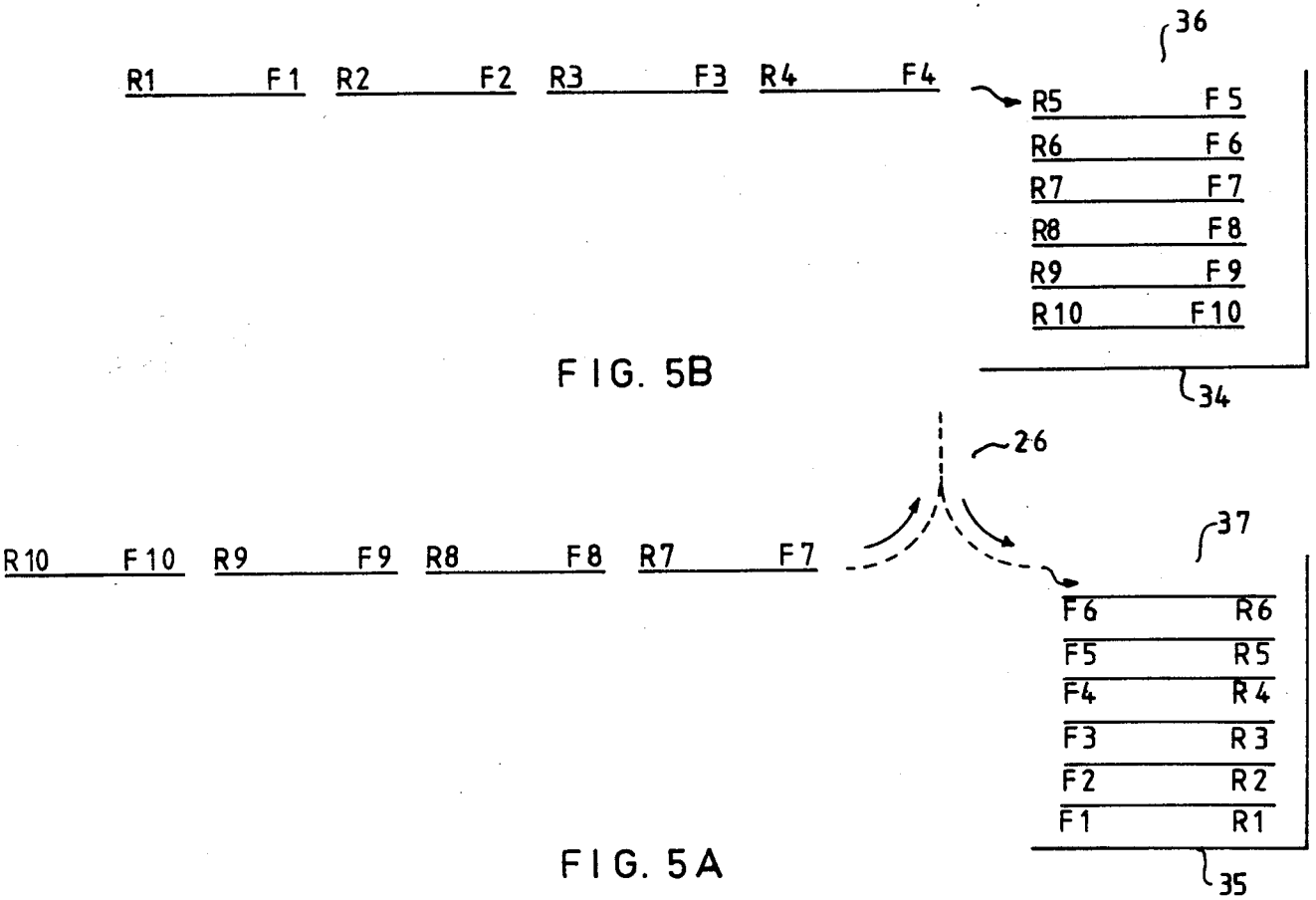

FIG. 3A diagramatically illustrates, for the condition illustrated in FIG. 2A, the sequence of transferred image information carried on the belt in the form of master images to be used repeatedly;

FIG. 3B is a diagramatic illustration similar to that of FIG. 3A, but in this case for the condition illustrated in FIG. 2B;

FIG. 4 illustrates schematically a duplicating apparatus embodying the invention, in which the sheets produced with image reproductions are automatically sorted; and FIGS. 5A and 5B illustrate the formation of equivalent stacks of sheets with use of an apparatus according to FIG. 4.

Figure 1:
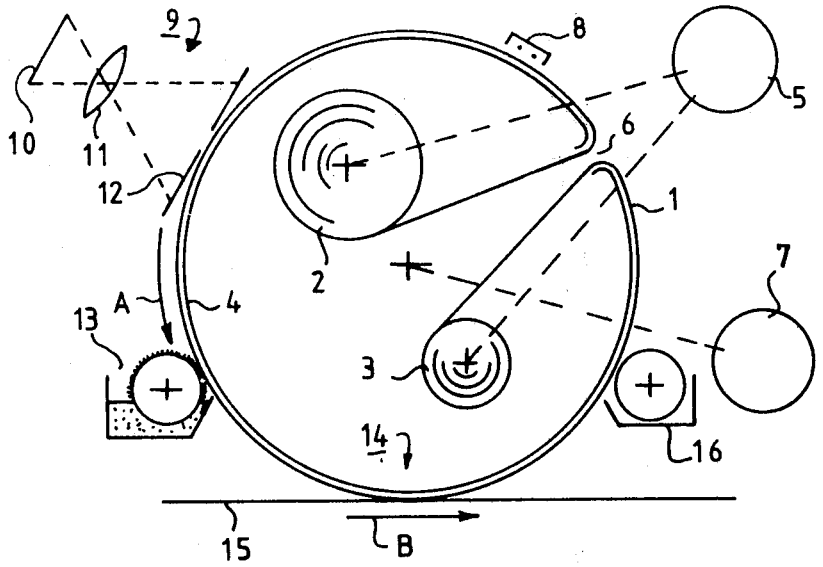
FIG. 1 shows schematically a reproduction apparatus embodying the invention, for producing copies according to the indirect electrophotographic process.

Referring first to FIG. 1, a photoconductive belt 1 of finite length is shown wound in part on a first supply reel 2 and in part on a second supply reel 3. The supply reels 2 and 3 are located inside a drum 4, and the belt 1 extends from the reel 2 to the reel 3 via an axial slot 6 in the drum 4 and via the circumferential surface of the drum 4. The reels 2 and 3 are connected with a drive unit 5 by which they can be rotated so that the belt 1 will be transported at will and at a constant velocity either from the first supply reel to the second or from the second supply reel to the first. Such a drive unit is disclosed, for example, in U.S. Pat. No. 3,706,489.

The drum 4 is rotatably supported in bearings in a frame (not illustrated) and can be rotated by a drive unit 7. A suitable drive unit is also disclosed in U.S. Pat. No. 3,706,489.

Various electrophotographic processing stations are disposed about the circumference of the drum 4. The part of the belt 1 that extends over the circumferential surface of the drum 4 is conveyed past the processing stations in the direction of the arrow A, at a process velocity $V_b$, in a way to be explained further with reference to FIG. 2A. During the movement of the belt 1, an imaging section of the belt is provided with an electrostatic charge in a charging station 8, and in the dark; then the electrostatically charged belt section is exposed in an exposure station 9 to a light image of an original 10 that is to be copied, thus forming an electrostatic charge image on the belt 1. During this exposure the original is illuminated by a light source (not illustrated) and the image is projected slitwise onto the belt 1 by means of an optical system 11 and a mask 12.

The electrostatic charge image formed at station 9 is passed through a developing station 13 where it is developed by a developing material, for instance a toner powder, into a visible image which is transferred from the belt 1 to a receiving material 15 in a transfer station 14. To that end the receiving material 15 is moved past the drum 4 in the direction of the arrow B at the velocity $V_b$ so that the section of belt 1 carrying the image to be transferred and the receiving material 15 have the same velocity in the transfer station 14.

The transferred image is fixed onto the receiving material 15 in a fixing station (not illustrated), after which the copy is ready. Meanwhile, any developing material not transferred to the receiving material 15 is removed from the belt 1 in a cleaning station 16.

The above description of an indirect electrophotographic copying apparatus provided with a drum 4 fitted with a photoconductive belt 1 is given only as one example of a reproduction apparatus in which image information present on a belt, such as the developing material applied imagewise on belt 1, is transferred to a receiving medium, such as a sheet material 15. Many other processes of image formation and image transfer are known and suitable for being carried out by the use of apparatus embodying the present invention. A few examples are: The transfer of a magnetic image formed on the belt to a magnetizable material; the transfer of an electrostatic charge image to an insulating material; the formation of a latent electrostatic image on an insulation belt with the aid of a row of electrode needles located axially along the drum 4; and others. The invention therefore is not restricted to a particular process of image formation and image transfer.

Since particulars of the means to be used for the formation and transfer of the image information in a particular process, such, for example, as the electrophotographic processing stations shown in FIG. 1, are not essentials of the invention, such means are not illustrated in the other figures of the drawings. For further simplification, the velocities and directions of movements in the transfer station 14, as indicated by arrows in FIGS. 2A, 2B, 3A, 3B, are counted as positive if the arrows are aimed toward the right, and negative if they are aimed toward the left. Further, the first supply reel 2 is that reel which serves as the belt feeding reel in the event that, with the drum 4 stationary and the drive unit 5 in operation, the belt 1 moves through the transfer station 14 in a positive direction; and the second supply reel 3 is that reel which serves as the belt collecting reel under those circumstances.

FIGS. 2A and 2B illustrate the way in which the velocity of the belt 1 in the transfer station 14 can be kept consistently the same, in both magnitude and direction, as the velocity $V_b$ of the receiving material 15.

In the condition of the apparatus as illustrated in FIG. 2A the first supply reel 2 is serving as the feed reel and the second supply reel 3 is serving as the collecting reel. Upon actuation of the drive unit 5 (FIG. 1) the belt 1 is transported from the supply reel 2 via the slot 6 and the circumferential surface of the drum 4, and again via the slot 6, to the supply reel 3. The direction of transport of the belt 1 over the circumferential surface of the drum 4 at a velocity $V_t$ is indicated by the arrow D. In accordance with the definition given above, this transport direction and the transport velocity are to be counted as positive. The transport of the receiving material 15 is in the transfer station 14 at a velocity $V_b$ is indicated by the arrow C. If $V_t$ is equal to $V_b$, then the drum 4 can remain stationary while an image is transferred at station 14. However, if $V_t$ is greater or smaller, respectively, than $V_b$, which can be desirable for a diversity of reasons, then the drum 4 must be moved through the transfer station 14 by means of the drive unit 7, in a negative or a positive direction, respectively, in order to transport the imaged side of the belt 1 through the transfer station 14 at the same velocity, in magnitude and direction, as the receiving material 15. A relationship of drum and belt transport velocities meeting this requirement is represented in FIG. 2A by the arrow E, indicating a negative peripheral velocity $V_d$ of the drum 4, and by the arrow F indicating a positive peripheral velocity $V_d$ of the drum 4.

All three of the cases mentioned can be summarized as follows: the peripheral velocity $V_d$ of the drum 4 is equal to the processing velocity $V_b$ minus the transport velocity $V_t$ of the belt 1 over the circumferential surface of the drum.

In the condition of the apparatus as illustrated in FIG. 2B the first supply reel 2 is serving as the collecting reel and the second supply reel 3 is serving as the feed reel. By means of the drive unit 5 (FIG. 1) the belt 1 is transported from the supply reel 3 via the slot 6 and the circumferential surface of the drum 4, and again via the slot 6, to the supply reel 2. The transport of the belt 1 over the circumferential surface of the drum 4 is at a velocity $V_t$ which is to be counted as negative as indicated by the arrow H. The transport of the receiving material 15 in the transfer station 14 at a velocity $V_b$ is indicated by the arrow G. In order to transport the imaged side of the belt 1 through the transfer station 14 nonetheless in a positive direction at the velocity $V_b$, the circumferential surface of the drum 4, relative to which the belt is moving in a negative direction to the velocity $V_t$, is moved in a positive direction at a velocity $V_d$ which, as indicated by the arrow J, is equal in magnitude to the sum of the magnitudes of $V_b$ and $V_t$.

Since the transport velocity $V_t$ of the belt 1 over the circumferential surface of the drum is negative, it can be asserted here, as well, that the peripheral velocity $V_d$ of the drum 4 is equal to the processing velocity $V_b$ minus the (now negative) transport velocity $V_t$ of the belt 1 over the circumferential surface of the drum 4.

Consequently, the situations of both FIG. 2A and FIG. 2B-which embrace all the possibilities in which the belt 1 can be conveyed over the circumferential surface of the drum 4-can be summarized as follows: the peripheral velocity $V_d$ of the drum 4 is at all times equal to the processing velocity $V_b$ minus the transport velocity $V_t$ of the belt 1 over the circumferential surface of the drum 4.

FIGS. 3A and 3B illustrate a way of transferring repeatedly to sheets of receiving material image information present on a belt, such as the belt 1, in the form of master images that can be used repeatedly. The master images are applied to the belt 1 successively and so that the length of one master image as viewed in the direction of transport of the belt corresponds to the length of a sheet of receiving material as viewed in the direction of movement of the image information through the transfer station 14.

An imaging section of the belt 1 as meant herein is a portion of the length of the belt on which one master image is present. Besides the image formation of the master image an imaging section usually will also comprise parts that are not provided with image information.

Thus, in FIGS. 3A and 3B an imaging section "9" is indicated as extending through the transfer station 14 with a master image thereon which extends for instance from location F9 to location R9. The location F9, for example, corresponds to the top edge of a sheet of text, location R9 then corresponding to the bottom edge of that sheet. In the situations outlined each master image covers substantially an entire imaging section of the belt, and the receiving material is present in the form of separate sheets 16, 17, 18 (FIG. 3A) and 19, 20 and 21 (FIG. 3B), respectively.

Also illustrated in FIGS. 3A and 3B are imaging sections "8" and "10" on which the master images F8–R8 and F10–R10 are carried by the belt 1. In the conditions illustrated in FIG. 3A the belt 1 is transported by operation of the drive unit 5 (FIG. 1) from the supply reel 2 to the supply reel 3 at a transport velocity $V_t$ (arrow L) relative to the circumferential surface of the drum 4, and $V_t$ has been chosen to be equal to the velocity $V_b$ (arrow K) of each sheet passed through the transfer section 14; so the drum is held stationary. Thus, in the conditions illustrated, a succession of copies is produced by transfers of image material from the master image F8–R8 onto sheet 16, from the master image F9–R9 onto sheet 17, from the master image F10–R10 onto sheet 18, and so forth.

FIG. 3B illustrates the equivalent conditions which apply after the direction of transport of the belt 1 over the circumferential surface of the drum 4 is reversed. Here again the imaging section carrying master image F9–R9 is shown located in the transfer station. With reference to FIG. 2B and the related description above it can be seen quite simply that, as indicated in FIG. 3B, the image information present in the master image F9–R9 is transferred from the corresponding imaging section of the belt to the receiving sheet 20. The transport direction of the belt 1 over the circumferential surface of the drum 4 is now negative as indicated by the arrow N. The rotation of the drum 4 is positive and at a greater velocity as indicated by the arrow P, while the transport of the receiving sheet 20 remains positive as indicated by the arrow M. As follows from the description relating to FIG. 2B, the peripheral velocity of $V_d$ of the drum 4 is equal in magnitude to the sum of the magnitude of the processing velocity $V_b$ of the receiving sheet 20 and the magnitude of the transport velocity $V_t$ of the belt 1 over the circumferential surface of the drum 4.

As a result of the rotation of the drum 4, the slot 6 as viewed in FIG. 3B moves in a counter-clockwise direction relative to the transfer station 14. At the same time, the band of the belt lying between locations F10 and R9 moves toward the slot 6 to disappear therein and be wound on reel 2, while the band or division between F8 and R7 moves from the reel 3 toward the slot 6 to emerge from the slot onto the drum surface. With a correct choice of the velocities $V_b$, $V_t$ and $V_d$ the belt division between F10 and R9 will disappear in the slot 6 at precisely the moment when the slot 6 is located in the transfer station 14. Consequently in that case, upon rotation of the drum 4, the master image F8–R8 on the imaging section carrying this image will precisely and fully emerge from the slot 6 so as to be transferred subsequently onto the next receiving sheet 21, commencing with the head F8 of this sheet as illustrated in FIG. 3B.

It will be evident from the description of FIGS. 3A and 3B that, with a correct choice of the transport and peripheral velocities, each master image can consistently be transferred in the same way onto a receiving sheet, independently of the direction of transport of the belt 1 over the circumferential surface of the drum 4. However, the sequence in which the different successive master images are transferred differs with the difference directions of transport of the belt over the circumferential surface of the drum, as will be explained further hereinafter with reference to FIG. 4. In selecting correctly the transport velocities to be employed under the conditions illustrated in FIG. 3B, the following two factors play a role: (1) the ratio between the length $L_i$ of a master image and the linear circumference $L_c$ of the drum 4, and (2) the ratio X between the peripheral velocity $V_d$ of the drum 4 and the processing velocity $V_b$. It can be demonstrated relatively simply that the following relationships apply:

$$V_d = V_b + V_t;$$

for the case of X being greater than 1 and equal to or less than 2, $$(L_i/L_c = (X-1)/X;$$

for the case of X being greater than or equal to 2, $$(L_i/L_c) = (1/X).$$

It results that when $X=2$, $L_i$ always is equal to one half of $L_c$.

Since the length $L_i$ of a master image will generally be fixed, being for example the length of a sheet of DIN A4 size, the other quantities mentioned can readily be selected to be in accord with the relationships mentioned above. It is also so apparent that in the case of X being equal to or greater than 2, the length $L_i$ of a master image should be smaller than the length of the corresponding imaging section of the belt in order to be able consistently to transfer all the image parts of each of the master images in their entirety to a sheet as the master image and the sheet pass through the transfer station.

FIG. 4 schematically represents a reproduction apparatus 30 as described hereinabove in an arrangement in which it serves as a duplicating apparatus. The image information is transferred in a transfer station 14 onto sheets of receiving material 23 which are conveyed through the transfer station 14 in the direction indicated by the arrow R. For leading the copy sheets from the transfer station 14 a conveyor system 24 is provided which comprises a first conveyor 25, a controllable sheet reversing unit 26, a second conveyor 27, a third conveyor 28 and a fourth conveyor 29.

The reversing unit 26 comprises an element 31 that can be swivelled into and out of the transport path of the sheets 23, and a control unit 32 for positioning the element 31. The control unit 32 comprises a signal input which, via a signal line 33, receives a control signal that represents the direction in which the motor 5 is transporting the belt 1 over the circumferential surface of the drum 4. Receiving trays 34 and 35, respectively, are associated with the conveyors 27 and 29 so that the sheets 23 deposited from these conveyors will form stacks in the trays. When the copy sheets 23 are being produced under the conditions illustrated in FIG. 3A the sheets 23 emerge from the transfer station 14 with the reproduced image information on top. Considering a sheet on which a master image Fn–Rn is reproduced to be sheet n, then the situation illustrated in FIG. 3A can be expressed as follows: the sheets 23 emerge from the transfer station 14 in the sequence 1, 2, 3, 4, 5, etc., with the reproduced image information on top (also see FIG. 5A). Analogously, when the copy sheets are being produced under the conditions illustrated in FIG. 3B the sheets 23 emerge from the transfer station 14 in the sequence . . . , 10, 9, 8, 7, 6, 5, 4, 3, 2, 1 (also see FIG. 5B), and likewise with the reproduced image information on top.

When the apparatus is operating under the conditions illustrated in FIGS. 3A and 5A the motor 5 emits a signal via the line 33 to the control unit 32, by which signal the reversing unit 26 is switched on. The sheets 23 then pass successively through the conveyor 25, the reversing unit 26, and the conveyors 28 and 29 and are deposited in the receiving tray 35 in the way indicated in FIG. 5A.

When the apparatus is operating under the conditions illustrated in FIGS. 3B and 5B the motor 5 emits a signal via the line 33 to the control unit 32, by which the reversing unit is switched off. The sheets 23 then pass successively through the conveyors 25 and 27 and are deposited in the receiving tray 34 in the way indicated in FIG. 5B.

As is apparent from FIGS. 5A and 5B, the stacks formed in the receiving trays 34 and 35 are completely identical to each other. Consequently, the duplicating apparatus illustrated in FIG. 4 need not be provided with a separate sorting unit.

It is to be understood that the references in the foregoing description to the transfer of image information to receiving material in the transfer station 14 are meant to apply to either direct transfer or indirect transfer. An example of direct transfer is the transfer of developing material from a developed electrostatic charge image to a sheet of receiving paper, as described in connection with FIG. 1. An example of indirect transfer is the transfer of an electrostatic charge image from the belt 1 to an insulating material, to be followed by development of the transferred charge image with developing material and, subsequently, transfer of the image of developing material from the insulating material to a sheet of receiving paper.

I claim:

1. A reproduction apparatus comprising a rotatable drum having mounted therein two reels for holding a finite length of belt that is impressible with image information, said belt extending and being movable between said reels over the circumferential surface of said drum; a transfer station adjacent to said surface and wherein image information is transferrable from said belt to receiving material moving through said station at a processing velocity; drive means for transporting said belt back and forth between said reels and thus over said drum surface and past said transfer station for transferring image information from the belt to the receiving material; and drum drive means operative when the belt is being transported in either direction over said drum surface to keep said drum at a peripheral velocity which, in magnitude and direction, is equal to said processing velocity minus the velocity at which the belt is being transported over said surface.

2. A reproduction apparatus according to claim 1, said belt being impressible with image information in the form of master images from each of which the image information is repeatedly reproducible on sheetlike receiving material passed through said transfer station, said apparatus further comprising a sheet reversing unit located in a path of transport of sheets carrying said informaton away from said station and means for activating said sheet reversing unit to reverse said sheets during the transport of said belt in one direction over said drum surface and for inactivating said sheet reversing unit during the transport of said belt in the other direction over said surface.

3. A reproduction apparatus according to claim 2, said means for activating and inactivating said sheet reversing unit comprising a signal transmitter for emitting a signal corresponding to the direction of transport of said belt over the circumferential surface of said drum and control means responsive to said signal for positioning said sheet reversing unit.

4. A reproduction apparatus according to claim 1, 2, or 3, by which the image information on said belt is reproducible on sheetlike receiving material passed through said transfer station and wherein the linear circumference of said drum is equal to twice the length of a sheet of said receiving material as viewed in the direction of movement of the image information through said transfer station; said drum drive means being operative to keep said drum stationary during the transport of said belt from a first to the second reel, and being operative during the transport of said belt from the second to the first reel to rotate said drum at a peripheral velocity which, in magnitude and direction, is equal to twice said processing velocity.

5. A method of reproducing on receiving material being moved at a given processing velocity through a transfer station at the periphery of a rotatable drum, image information impressed on a belt of finite length being moved through said station at the same velocity, which method comprises, while winding said belt from a first reel inside said drum onto a second reel inside the drum, transporting said belt over the circumferential surface of the drum in one direction and at a first velocity relative to said surface and keeping said drum at a peripheral velocity equal in magnitude and direction to said processing velocity minus said first velocity; and while winding said belt from said second reel onto said first reel, transporting said belt over said surface in the opposite direction at a second velocity relative to said surface and rotating said drum at a peripheral velocity equal in magnitude and direction to said processing velocity minus said second velocity.

6. A method according to claim 5 and wherein said image information on said belt is reproducible on sheetlike receiving material passed through said transfer station to provide reproductions of the information on sheets of a given length as viewed in the direction of movement of said material through said station and said drum is provided with a linear circumference equal to twice said sheet length, said method comprising keeping said drum stationary during transport of said belt in said one direction relative to said drum surface, and during transport of said belt in the opposite direction relative to said surface rotating said drum at a peripheral velocity equal in magnitude and direction to twice said processing velocity.

7. A method according to claim 5 or 6 and wherein said image information on said belt comprises a succession of master images that are repeatedly reproducible on sheetlike receiving material passed through said transfer station to provide reproductions of the images on successive sheets of said material, said method further comprising transporting said reproduction sheets successively into a stack thereof with the respective reproductions thereon facing the same way during transport of said belt in one direction relative to said drum surface, and during transport of said belt in the opposite direction relative to said surface transporting said reproduction sheets into a stack thereof with the reproductions thereon facing the opposite way, whereby the stacks formed of said sheets are substantially identical and the sheets of each stack respectively carry reproductions of said images in the order of succession of said images on said belt.

* * * * *